US011306875B2

(12) United States Patent
Renault

(10) Patent No.: US 11,306,875 B2
(45) Date of Patent: Apr. 19, 2022

(54) SYSTEMS AND METHODS FOR CONTROLLING GAS FLOW IN TRANSPORTATION REFRIGERATION SYSTEMS

(71) Applicant: CARRIER CORPORATION, Palm Beach Gardens, FL (US)

(72) Inventor: Loic Renault, Saint Etienne du Rouvray (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/973,680

(22) PCT Filed: Dec. 5, 2019

(86) PCT No.: PCT/US2019/064637
§ 371 (c)(1),
(2) Date: Dec. 9, 2020

(87) PCT Pub. No.: WO2020/118024
PCT Pub. Date: Jun. 11, 2020

(65) Prior Publication Data

US 2021/0293386 A1 Sep. 23, 2021

(30) Foreign Application Priority Data

Dec. 6, 2018 (EP) ..... 8306625

(51) Int. Cl.
*F17C 13/04* (2006.01)
*F17C 13/02* (2006.01)
(Continued)

(52) U.S. Cl.
CPC ..... *F17C 13/04* (2013.01); *F17C 13/025* (2013.01); *F02D 19/0644* (2013.01);
(Continued)

(58) Field of Classification Search
CPC ..... F17C 13/04; F17C 13/025; F17C 2205/0142; F17C 2205/0326;
(Continued)

(56) References Cited

U.S. PATENT DOCUMENTS 4,527,600 A * 7/1985 Fisher ..... B67D 7/08 141/4
8,100,076 B1 1/2012 Shivers, III et al.
(Continued)

FOREIGN PATENT DOCUMENTS

EP 2287458 A2 2/2011
EP 2199655 B1 8/2011
(Continued)

OTHER PUBLICATIONS

Extended European Search Report issued in Application No. 18306625.7 dated Jul. 23, 2019, 7 pages.
(Continued)

*Primary Examiner* — Grant Moubry
(74) *Attorney, Agent, or Firm* — Cantor Colburn LLP

(57) ABSTRACT

A transportation refrigeration system includes a transportation refrigeration unit, a gas circuit connected to the transportation refrigeration unit and arranged to connect thereto a split bottle gas supply having a plurality of electric lock-off valves, and a controller. The controller is operably connected to the transportation refrigeration unit and is responsive to instructions recorded on a memory to close the electric lock-off valves of the split bottle gas supply. The instructions also cause to the controller to receive a first measurement of gas pressure in the gas circuit, open a first of the electric lock-off valves of the split bottle gas supply, receive a second measurement of gas pressure in the gas circuit, and determine health of the first electric lock-off valve using the first and second measurements of gas
(Continued)

pressure in the gas circuit. Related methods and computer program products are also described.

20 Claims, 4 Drawing Sheets

(51) Int. Cl.
*F02M 21/02* (2006.01)
*F02D 19/06* (2006.01)

(52) U.S. Cl.
CPC .. *F02M 21/0242* (2013.01); *F17C 2205/0142* (2013.01); *F17C 2205/0326* (2013.01); *F17C 2221/033* (2013.01); *F17C 2221/035* (2013.01); *F17C 2250/032* (2013.01); *F17C 2250/043* (2013.01); *F17C 2270/0171* (2013.01)

(58) Field of Classification Search
CPC ..... F17C 2221/033; F17C 2221/035; F17C 2250/032; F17C 2250/043; F17C 2270/0171; F17C 2223/0123; F17C 2227/043; F02M 21/0242; F02D 19/0644
See application file for complete search history.

(56) References Cited

U.S. PATENT DOCUMENTS

| | | | | |
|---|---|---|---|---|
| 8,607,830 | B2 | 12/2013 | White | |
| 9,074,730 | B2 * | 7/2015 | Cohen | F17C 5/06 |
| 9,238,865 | B2 * | 1/2016 | Pomarede | C23C 16/45561 |
| 9,279,541 | B2 * | 3/2016 | Cohen | F17C 7/00 |
| 9,284,895 | B2 | 3/2016 | Naidu et al. | |
| 9,416,918 | B2 | 8/2016 | Nettis et al. | |
| 9,598,946 | B2 | 3/2017 | Shomody et al. | |
| 9,784,411 | B2 | 10/2017 | Diggins | |
| 9,976,523 | B2 * | 5/2018 | Sarikaya | F02D 19/027 |
| 10,072,342 | B2 | 9/2018 | Prescott et al. | |
| 10,100,980 | B2 | 10/2018 | Morris et al. | |
| 10,228,188 | B2 * | 3/2019 | Thogersen | F25B 49/005 |
| 2006/0246177 | A1 | 11/2006 | Miki et al. | |
| 2009/0294470 | A1 | 12/2009 | Lampe | |
| 2010/0000252 | A1 | 1/2010 | Morris et al. | |
| 2011/0030399 | A1 | 2/2011 | Lifson et al. | |
| 2011/0140850 | A1 | 6/2011 | Wassel et al. | |
| 2012/0318403 | A1 * | 12/2012 | Cohen | F17C 5/06 141/3 |
| 2014/0283788 | A1 | 9/2014 | Bleyer | |
| 2015/0206359 | A1 | 7/2015 | Ahmad et al. | |
| 2015/0345706 | A1 | 12/2015 | Whiteman et al. | |
| 2016/0177857 | A1 | 6/2016 | Sarikaya et al. | |
| 2017/0284603 | A1 | 10/2017 | Song et al. | |
| 2017/0307140 | A1 | 10/2017 | Rado | |

FOREIGN PATENT DOCUMENTS

| | | | |
|---|---|---|---|
| WO | 2017192570 | A1 | 11/2017 |
| WO | 2017205412 | A1 | 11/2017 |
| WO | 2017208044 | A1 | 12/2017 |
| WO | 2017222451 | A1 | 12/2017 |

OTHER PUBLICATIONS

International Search Report issued in Application No. PCT/US2019/064637 dated Mar. 16, 2020, 6 pages.
Leak Detection in Natural Gas and Propane Commercial Motor Vehicles Course. U.S Department of Transportation Federal Motor Carrier Safety Administration. Jul. 2015. 43 Pages.
Written Opinion issued in Application No. PCT/US2019/064637 dated Mar. 16, 2020, 8 pages.

* cited by examiner

SYSTEMS AND METHODS FOR CONTROLLING GAS FLOW IN TRANSPORTATION REFRIGERATION SYSTEMS

CROSS REFERENCE TO RELATED APPLICATIONS

This application claims the benefit of EP Application No. 18306625.7, filed on 6 Dec. 2018, which is incorporated herein by reference in its entirety.

BACKGROUND

The present disclosure relates to transport refrigeration systems, and more specifically, to controlling flow of gas to transportation refrigeration units powered by compressed gas.

Cold chain distribution systems are used to transport and distribute cargo, or more specifically perishable goods and environmentally sensitive goods (herein referred to as perishable goods) that may be susceptible to temperature, humidity, and other environmental factors. Perishable goods may include but are not limited to fruits, vegetables, grains, beans, nuts, eggs, dairy, seed, flowers, meat, poultry, fish, ice, and pharmaceuticals. Advantageously, cold chain distribution systems allow perishable goods to be effectively transported and distributed without damage or other undesirable effects.

Refrigerated vehicles and trailers are commonly used to transport perishable goods in cold chain distribution systems. Typically, a transport refrigeration system is mounted to the vehicle or to the trailer in operative association with a cargo space defined within the vehicle or trailer for maintaining a controlled temperature environment within the cargo space.

Conventionally, transport refrigeration systems used in connection with refrigerated vehicles and refrigerated trailers includes a transport refrigeration unit having a refrigerant compressor, a condenser with one or more associated condenser fans, an expansion device, and an evaporator with one or more associated evaporator fan, which are connected via appropriate refrigerant lines in a closed refrigerant flow circuit. Air or an air/gas mixture is drawn from the interior volume of the cargo space by means of the evaporator fan(s) associated with the evaporator, passed through the air side of evaporator in heat exchange relationship with refrigerant whereby refrigerant absorbs heat from the air, thereby cooling the air. The cooled air is then supplied back to the cargo space.

Some transport refrigeration units are powered by engines powered by compressed natural gas (CNG), generally from CNG gas bottles carried by the vehicle. Electric lock-off valves generally connect compressed natural gas bottles to the transport refrigeration unit through a pressure sensor, which provides an indication of the average CNG pressure available from the CNG bottles during operation. Typically, there is no pressure information available for each CNG bottle individually, and CNG bottle filling and emptying is not monitored at each individual bottle.

Such systems and methods have generally been considered suitable for their intended purpose. However, there remains a need for improved power supplies for transportation refrigeration units and transportation refrigeration units. The present disclosure provides a solution to this need.

BRIEF DESCRIPTION

According to one embodiment, a transportation refrigeration system includes a transportation refrigeration unit (TRU), a gas circuit connected to the TRU and arranged to connect thereto a split bottle gas supply having a plurality of electric lock-off valves, and a controller. The controller is operably connected to the TRU and responsive to instructions recorded on a memory to close the electric lock-off valves of the split bottle gas supply, receive a first measurement of gas pressure in the gas circuit, open a first of the electric lock-off valves of the split bottle gas supply, receive a second measurement of gas pressure in the gas circuit, and determine health of the first electric lock-off valve using the first and second measurements of gas pressure in the gas circuit.

In addition to one or more of the features described above, or as an alternative, further embodiments may include wherein the instructions cause the controller to start the gas engine after opening the first electric lock-off valve.

In addition to one or more of the features described above, or as an alternative, further embodiments may include wherein the instructions cause the controller to close the first electric lock-off valve before receiving the second measurement of gas pressure in the gas circuit.

In addition to one or more of the features described above, or as an alternative, further embodiments may include wherein the instructions cause the controller to calculate a difference between the first measurement and the second measurement of gas pressure in the gas circuit, determine that the first electric lock-off valve is operating normally when the difference is greater than a predetermined value, and determine that the first electric lock-off valve is not operating normally when difference is within the predetermined value.

In addition to one or more of the features described above, or as an alternative, further embodiments may include wherein the instructions cause the controller to sequentially determine health of each of the electric lock-off valves in the split bottle gas supply after determining health of the first electric lock-off valve.

In addition to one or more of the features described above, or as an alternative, further embodiments may include a user interface operatively associated with the controller, wherein the instructions cause the controller to display the determined health of the first lock-off valve on the user interface.

In addition to one or more of the features described above, or as an alternative, further embodiments may include wherein the instructions cause the controller to close the electric lock-off valves subsequent to receiving indication that the split gas bottle gas supply has been charged in a filling operation.

In addition to one or more of the features described above, or as an alternative, further embodiments may include a door switch disposed in communication with the controller and arranged for detecting displacement of gas filling box door during a filling operation.

In addition to one or more of the features described above, or as an alternative, further embodiments may include a pressure sensor arranged to measure gas pressure in the gas circuit and in communication with the controller.

In addition to one or more of the features described above, or as an alternative, further embodiments may include, wherein the gas circuit is first gas circuit, and further comprising a second gas circuit gas circuit connected to the first gas circuit.

In addition to one or more of the features described above, or as an alternative, further embodiments may include a TRU gas engine operatively associated with the TRU, a split bottle gas supply connected to the TRU gas engine by the first gas circuit, a gas filling box connected to the split bottle gas supply by the first gas circuit, a second gas circuit connected to the gas filling box, a main gas bottle connected to the gas filling box by the second gas circuit, and a prime mover gas engine connected to the main gas bottle by the second gas circuit.

In addition to one or more of the features described above, or as an alternative, further embodiments may include a split bottle gas supply connected to the gas circuit. The split bottle gas supply may include a pressure sensor connected to the gas circuit, a manifold connected to the pressure sensor, and a first gas bottle with a first electric lock-off valve connected to the manifold, a first relay operatively associated with the first electric lock-off valve. One or more second gas bottle with a second electric lock-off valve may be connected to the manifold, a relay operatively associated with each of the at one second electric lock-off valve, the controller may be disposed in communication with the pressure sensor to receive pressure measurements therefrom, and the controller operatively connected to the first electric lock-off valve and the second electric lock-off valve by the relay associated thereto to isolate the gas bottle connected to the lock-off valve from the pressure sensor.

According to another embodiment, a method of determining health of electric lock-off valves in a split bottle gas supply includes, at a transportation refrigeration system as described above, closing the electric lock-off valves of the split bottle gas supply and receiving a first measurement of gas pressure in the gas circuit. A first of the electric lock-off valves of the split bottle gas supply is opened, a second measurement of gas pressure in the gas circuit is received, and health of the first electric lock-off valve determined using the first and second measurements of gas pressure in the gas circuit.

In addition to one or more of the features described above, or as an alternative, further embodiments may include starting the gas engine after opening the first electric lock-off valve and closing the first electric lock-off valve before receiving the second measurement of gas pressure in the gas circuit.

In addition to one or more of the features described above, or as an alternative, further embodiments may include displaying health of the first electric lock-off valve on a user interface.

In addition to one or more of the features described above, or as an alternative, further embodiments may include calculating a difference between the first measurement and the second measurement of gas pressure in the gas circuit, determining that the first electric lock-off valve is operating normally when the difference is greater than a predetermined value, and determining that the first electric lock-off valve is not operating normally when difference is within the predetermined value.

In addition to one or more of the features described above, or as an alternative, further embodiments may include sequentially determining health of each of the electric lock-off valves in the split bottle gas supply after determining health of the first electric lock-off valve.

In addition to one or more of the features described above, or as an alternative, further embodiments may include detecting displacement of gas filling box door during a filling operation and closing the electric lock-off valves after receiving indication that the split gas bottle gas supply has been charged in the filling operation.

According to yet another embodiment, a computer program product tangibly embodied on a computer readable medium includes instructions that, when executed by a processor, cause the processor to perform operations including closing electric lock-off valves of a split bottle gas supply, receiving a first measurement of gas pressure in a gas circuit connected to the split bottle gas supply, opening a first of the electric lock-off valves of the split bottle gas supply, receiving a second measurement of gas pressure in the gas circuit, and determining health of the first electric lock-off valve using the first and second measurements of gas pressure in the gas circuit.

In addition to one or more of the features described above, or as an alternative, further embodiments may include, sequentially determining health of each of the electric lock-off valves in the split bottle gas supply after determining health of the first electric lock-off valve.

Technical effects of embodiments of the present disclosure include assessing health of the electric lock-off valves connecting bottles of a split bottle gas supply to a gas circuit. In certain embodiments the health of electric lock-off valves is determined in a split bottle gas supply having a greater number of electric lock-off valves than pressure sensors, such as gas circuit having a singular pressure sensor.

The foregoing features and elements may be combined in various combinations without exclusivity, unless expressly indicated otherwise. These features and elements as well as the operations thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION

Figure 1:
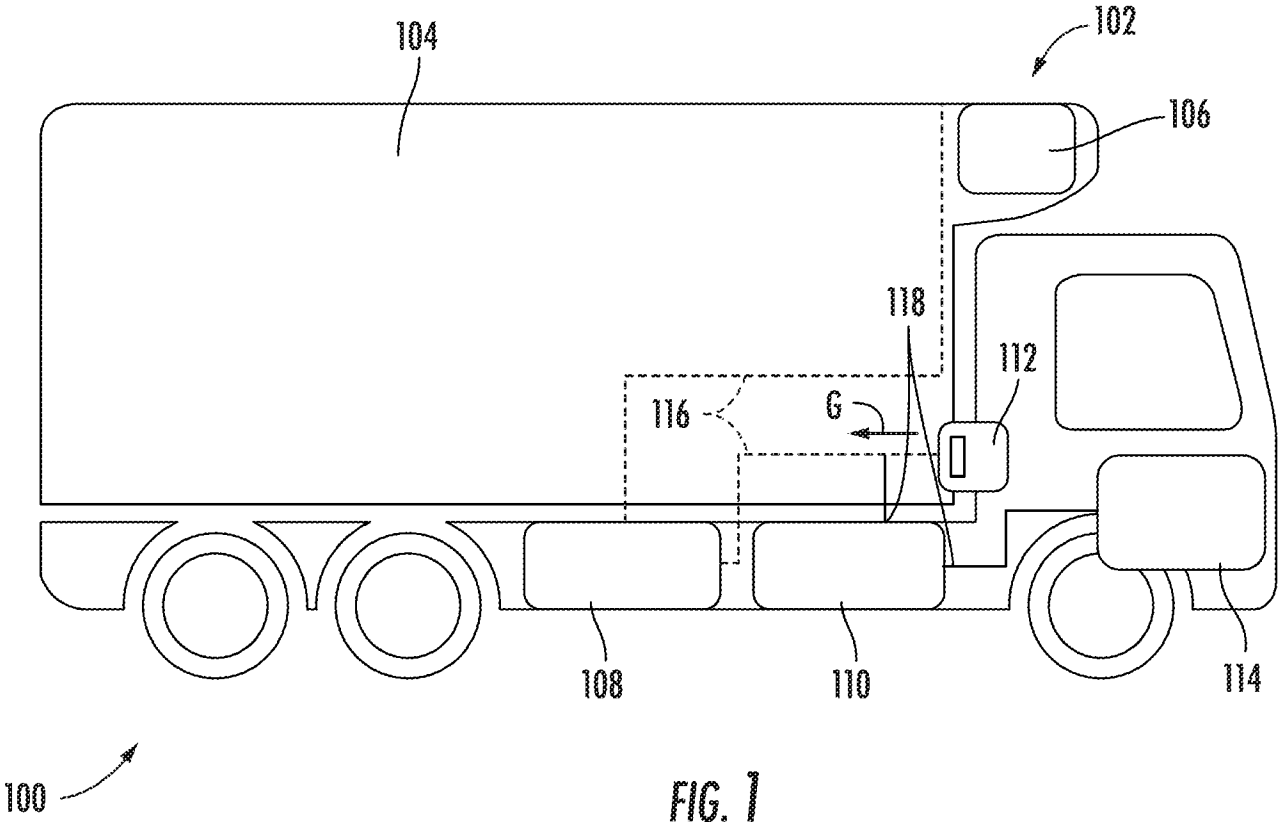
FIG. 1 is a schematic view of a transportation refrigeration system constructed in accordance with the present disclosure, showing transportation refrigeration unit (TRU) having a controller and a gas engine connected to a split bottle gas by a gas supply.

Reference will now be made to the drawings wherein like reference numerals identify similar structural features or aspects of the subject disclosure. For purposes of explanation and illustration, and not limitation, a partial view of an exemplary embodiment of a transportation refrigeration system in accordance with the disclosure is shown in FIG. 1 and is designated generally by reference character 100. Other embodiments of transportation refrigeration systems, methods of controlling gas flow in transportation refrigeration systems, and computer program products for controlling gas flow in transportation refrigeration units in accordance with the present disclosure, or aspects thereof, are provided in FIGS. 2-4, as will be described. The systems and methods described herein can be used for monitoring the health of electric lock-off valves in split bottle gas supplies for transportation refrigeration systems, such as four (4) bottle compressed natural gas (CNG) gas supplies carried by vehicles, though the present disclosure is not limited to systems having four gas bottles or to transportation refrigeration systems carried by any specific type of vehicle in general.

Referring to FIG. 1, transportation refrigeration system 100 is shown. Transportation refrigeration system 100 includes a transportation refrigeration unit (TRU) 102, a cold box 104, and a TRU gas engine 106. Transportation refrigeration system 100 also includes a split bottle gas supply 108, a main bottle 110, a gas filling box 112, and a prime mover gas engine 114. Transportation refrigeration system 100 additionally includes a first gas circuit 116 and a second gas circuit 118.

The TRU gas engine 106 is operably associated with the TRU 102 and provides mechanical power for one or more refrigeration component of the TRU 102. TRU 102 in turn includes a plurality of refrigeration components arranged in a refrigeration circuit and operating according to a refrigeration cycle to cool an associated conditioned space 10 (shown in FIG. 2) refrigerated space located within cold box 104. For example, in certain embodiments the refrigeration circuit includes a compressor, a condenser, an expansion valve, and an evaporator interconnected to one another by working fluid conduit segments. The refrigeration circuit can be, for example, as described as described in U.S. Patent Application No. 2011/0030399 A1, published Feb. 10, 2011, the contents of which are incorporated herein by reference in their entirety.

The main bottle 110 is configured and adapted for providing a flow of compressed gas to the prime mover gas engine 114. In this respect the main bottle 110 is connected to the prime mover gas engine 114 by the second gas circuit 118, which can be an original equipment manufacturer (OEM) gas circuit provided with the vehicle carrying TRU 102. The main bottle 110 is also connected to the gas filling box 112 for receiving therethrough a charge of compressed gas G. In certain embodiments the compressed gas G is natural gas. In accordance with certain embodiments the compressed gas is propane. It is also contemplated that, in accordance with certain embodiments, the compressed gas G can be hydrogen gas.

The first gas circuit 116 is configured and adapted for providing a flow of compressed gas to the TRU gas engine 106. In this respect the first gas circuit 116 connects the gas filling box 112 to bottles of the split bottle gas supply 108. The first gas circuit 116 also connects the split bottle gas supply 108 to the TRU gas engine 106. It is contemplated that, in accordance with certain embodiments, the first gas circuit 116 convey the same compressed gas, i.e., compressed gas G, as that conveyed by the second gas circuit 118. In certain embodiments the first gas circuit 116 and the second gas circuit 118 can be in fluid communication with one another as well as with a fill port located in the gas filling box 112 for charging both the split bottle gas supply 108 and the main bottle 110 with compressed gas G from the gas filling box 112. In accordance with certain embodiments the first gas circuit 116 can be added with TRU 102 as a modification or retrofit kit, for example, to convert a generic vehicle equipped with a gas engine into a specialized transportation refrigeration system for use in a cold chain.

Figure 2:
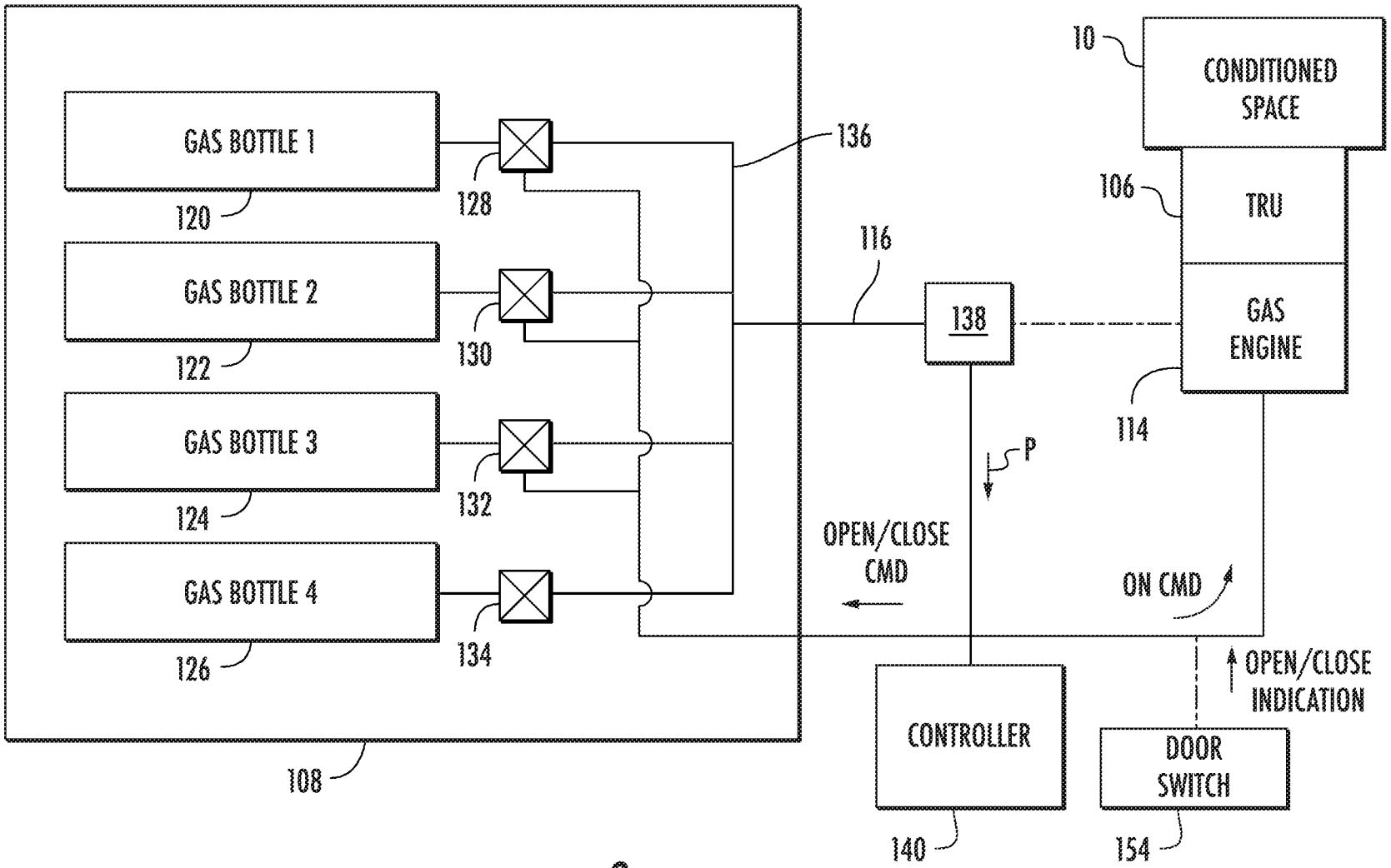
FIG. 2 is a schematic view of the split bottle gas supply of FIG. 1, showing gas bottles with electric lock-off valves connected to the gas engine by the gas circuit and a singular pressure sensor.

With reference to FIG. 2, split bottle gas supply 108 is shown. As shown in FIG. 2, split bottle gas supply 108 is a four (4) bottle supply having four gas bottles configured for retaining a charge of compressed gas and four (4) electric lock-off valves connecting respective bottles to the first gas circuit 116. In this respect the split bottle gas supply 108 includes a first gas bottle 120, a second gas bottle 122, a third gas bottle 124, and a fourth gas bottle 126. The split bottle gas supply 108 additionally has a first electric lock-off valve 128, a second electric lock-off valve 130, a third electric lock-off valve 132, and a fourth electric lock-off valve 134. Although shown and described herein as having four (4) gas bottles it is to be understood and appreciated that the present disclosure can be benefit transportation refrigeration systems having fewer than four bottles and more than four bottles, as suitable for an intended application.

The first electric lock-off valve 126 connects the first gas bottle 120 to the first gas circuit 116 through a gas manifold 136. Similarly, the second electric lock-off valve 128 connects the second gas bottle 124 to the first gas circuit 116 through the gas manifold 136, the third electric lock-off valve 130 connects the third gas bottle 124 to the first gas circuit 116 through the gas manifold 136, and the fourth electric lock-off valve 134 connects the fourth gas bottle 126 to the first gas circuit 116 through the gas manifold 136. The gas manifold 136 in turn is in communication with the first gas circuit 116, and therethrough with the TRU gas engine 106, and a pressure sensor 138.

The pressure sensor 138 is configured and adapted to provide measurement of gas pressure within the first gas circuit 116. The gas pressure within the first gas circuit 116 is in turn influenced by (or is equivalent to) the average of the pressure of the gas bottles in fluid communication with the first gas circuit 116. For example, when each of the electric lock-off valves 128-134 are open the pressure measured by pressure sensor 138 indicates an average of the pressure within each of the gas bottles 120-126. In certain embodiments the electric lock-off valves 128-134 can include solenoid-driven valve members that move between open and closed positions according to whether the solenoid is energized or de-energized. In the exemplary embodiment described herein electric lock-off valves 128-134 are configured such that the respective electric lock-off valve is closed when no current is applied to the solenoid. As will be appreciated by those of skill in the art in view of the present disclosure, electric lock-off valves of having different arrangements can also benefit from the present disclosure.

As will be appreciated by those of skill in the art in view of the present disclosure, electric lock-off valves employed by split bottle gas supplies can sometimes function abnormally. For example, one or more of the electric lock-off valves employed by a split bottle gas supply can remain open when commanded to close, remain closed when commanded to open, and/or remain partially open when commanded to open or close, potentially reducing the reliability of the transportation refrigeration system supplied by the split bottle gas supply. As will also be appreciated by those of skill in the art in view of the present disclosure, when a singular pressure sensor is used to monitor pressure in the transportation refrigeration system, it can be difficult to determine when an electric lock-off valve is functioning abnormally due to the tendency of the pressure sensor to report the average of the pressure present in the bottles connected by electric lock-off valves with normal function. To provide visibility into whether the electric lock-off valves 128-134 are functioning normally or abnormally TRU 102 includes a controller 140, which is configured and adapted for determining health of each of electric lock-off valves 128-134.

Figure 3:
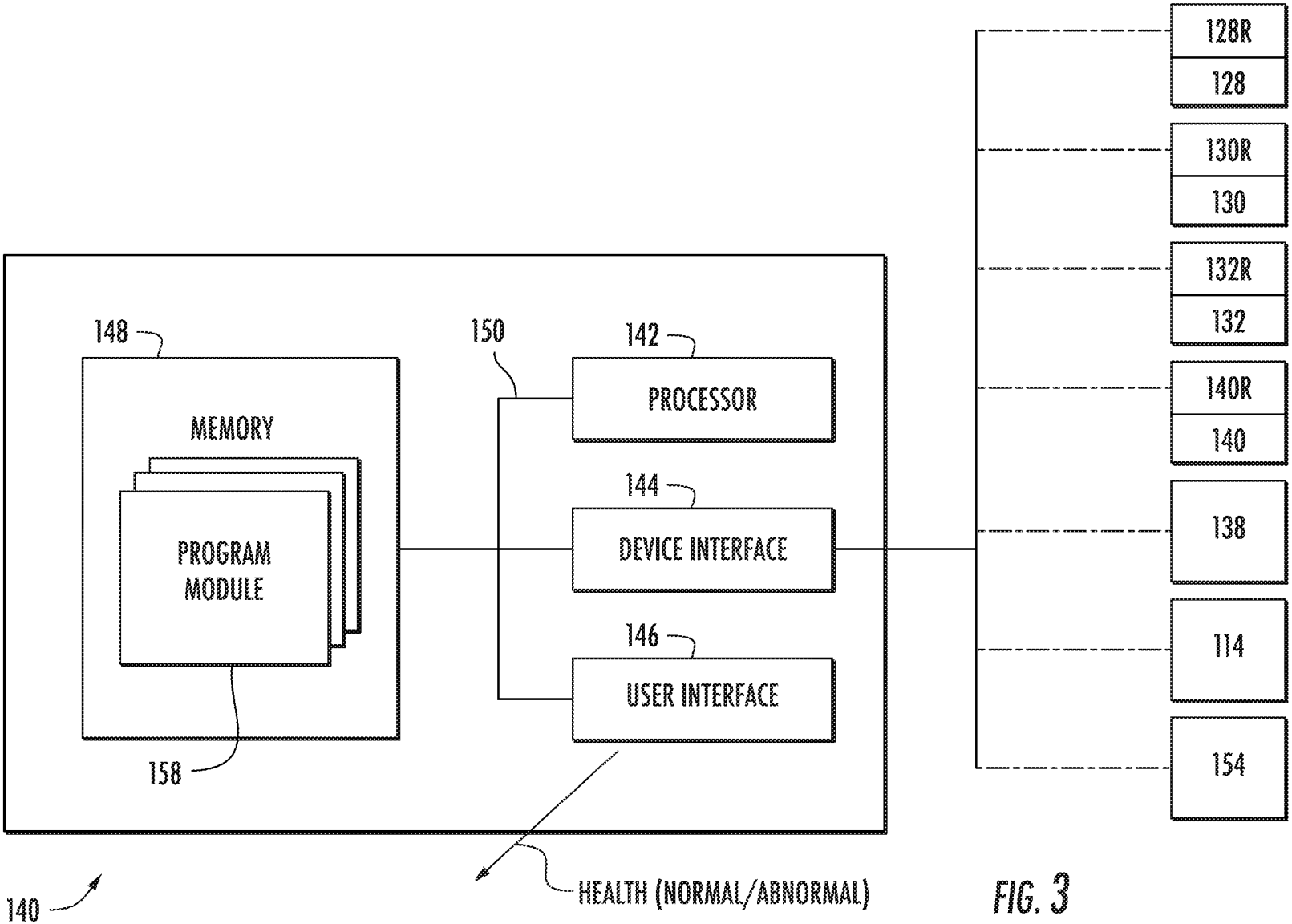
FIG. 3 is a schematic view of the controller illustrated in FIG. 1, showing a computer program product including a machine-readable medium with instructions recorded in program modules on the machine-readable medium.

With reference to FIG. 3, the controller 140 is shown. The controller 140 includes a processor 142, a device interface 144, a user interface 146, and a memory 148. The processor 142 is disposed in communication with the device interface 144, the user interface 146, and the memory 148 through an internal link 150. The user interface 146 is configured and adapted for providing information to a user and/or receiving input from a user. The device interface 144 is disposed in communication through an external link 152 with the pressure sensor 138 and the electric lock-off valves 128-134, the processor 142 thereby being disposed in communication with the pressure sensor 138 and operatively connected to the electric lock-off valves 128-134. The processor 142 is additionally disposed in communication with a filling box door switch 154 through the device interface 144, which provides therethrough to controller indication of completion of gas bottle filling event.

The memory 148 has a plurality of program modules 158 recorded on it that, when read by the processor 142, cause the controller 140 to execute certain operations. Among those operations are the operations of a method 200 (shown in FIG. 4) of determining health of electric lock-off valves in a split bottle gas supply, as will be described. In certain embodiments the memory 148 includes a computer program product 160 tangibly embodied thereon that, when executed by the processor 142, cause the processor 142 (and thereby the controller 140) to close the electric lock-off valves 128-134 (shown in FIG. 2) of the split bottle gas supply 108 and receive a first measurement of gas pressure in the first gas circuit 116 connected to the split bottle gas supply 108. The first electric lock-off valve 128 of the split bottle gas supply 108 is then opened, a second measurement of gas pressure in the first gas circuit 116 is received, and determination of health of the first electric lock-off valve 128 made using the first and second measurements of gas pressure in the first gas circuit 116. It is contemplated that health of each of the electric lock-off valves 128-134 be determined sequentially by repeating these operations for electric lock-off valves 130-134 subsequent to determining the health of the first electric lock-off valve 128.

As shown in FIG. 3 TRU 102 includes four (4) relays, i.e. relays 128R-134R. Each of the four relays is disposed in communication with the controller 140 and is in operative association with one of the four (4) electric lock-off valves of the split bottle gas supply 108. It is contemplated that, in certain embodiments, that TRU 102 include a single relay for association with each of the electric lock-off valves, the single relay providing independent actuation of the associated electric lock-off valve. As will be appreciated by those of skill in the art in view of the present disclosure, this provides the capability to place a singular gas bottle in communication with the singular pressure sensor, in isolation from the other gas bottles, thereby allowing for assessment of the operation of the electric lock-off valve associated with the gas bottle.

Figure 4:
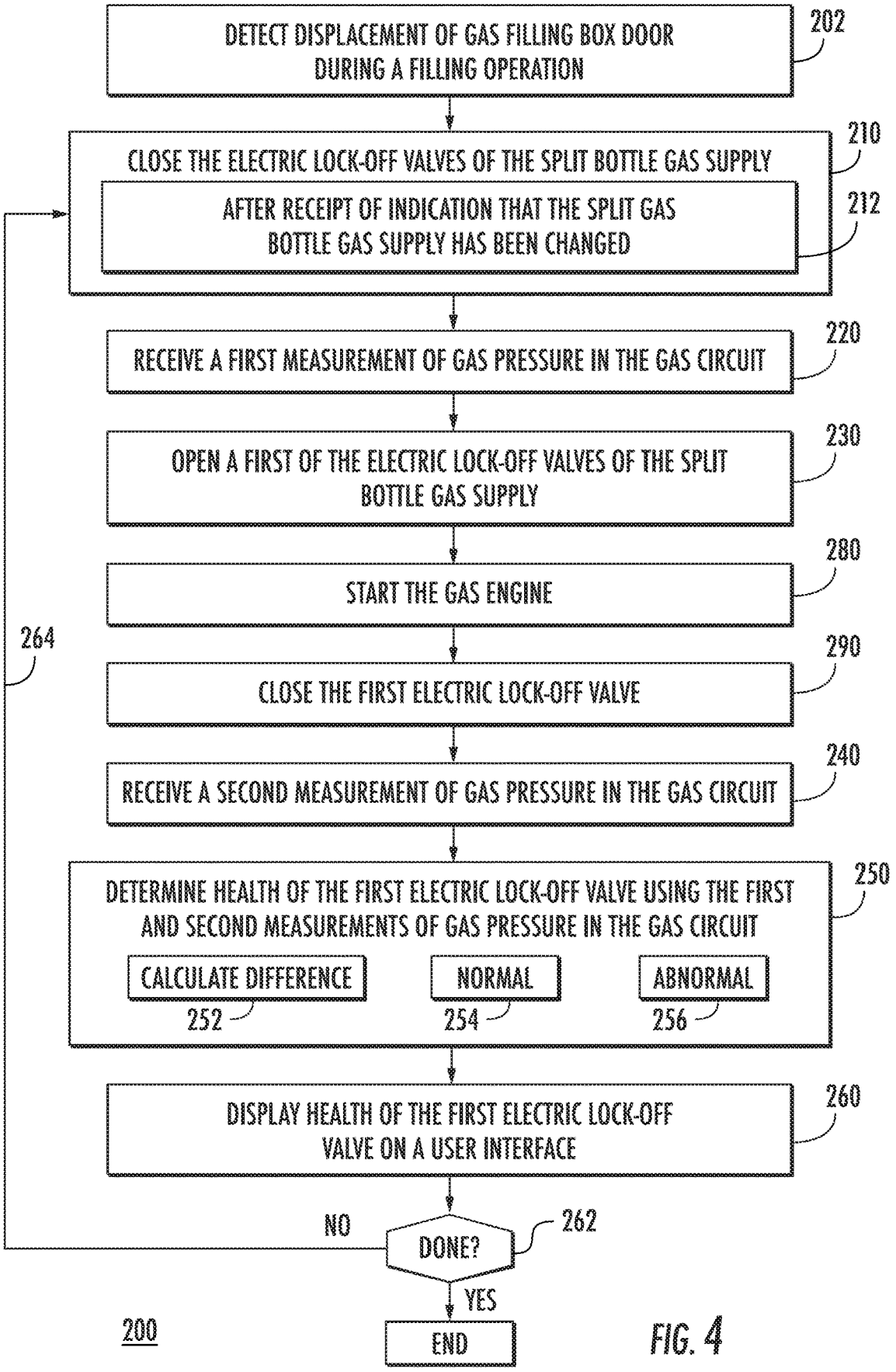
FIG. 4 is a process flow diagram of a method of determining health of electric lock-off valves of a split bottle gas supply, showing operations of the method.

With reference to FIG. 4, method 200 of determining health of electric lock-off valves in a split bottle gas supply, e.g., split bottle gas supply 108 (shown in FIG. 2), is shown. The method 200 includes, at a TRU such as the TRU 100 (shown in FIG. 1), closing the electric lock-off valves of the split bottle gas supply, e.g., the electric lock-off valves 128-134 (shown in FIG. 2), as shown with box 210. A first measurement of gas pressure in a gas circuit, e.g., the first gas circuit 116 (shown in FIG. 1), as shown with box 220. A first of the electric lock-off valves of the split bottle gas supply is opened, e.g., the first electric lock-off valve 128 (shown in FIG. 2), as shown with box 230, and a second measurement of gas pressure in the gas circuit received, as shown with box 240. Health of the first electric lock-off valve is determined using the first and second measurements of gas pressure in the gas circuit, as shown with box 250.

In certain embodiments health of the electric lock-off can be determined by calculating the difference between the first gas pressure measurement and the second gas pressure measurement, as shown with box 252. When the difference between the second gas pressure measurement and the first gas pressure measurement is above a predetermined value the operation of the electric lock-off valve is determined to be normal, as shown with box 254. When the difference between the second gas pressure measurement and the first gas pressure measurement is below the predetermined value the operation of the electric lock off valve is determined to be abnormal, as shown with box 256.

As shown with box 260, the health determination can thereafter be displayed on a user interface, e.g., the user interface 146 (shown in FIG. 3). As will be appreciated by those of skill in the art in view of the present disclosure, displaying the health determination for each electric lock-off valve can improve reliability of the transportation refrigeration as abnormal operation can be detected more rapidly, and in certain embodiments automatically in association with gas fill events, during routine operation of the transportation refrigeration system.

In accordance with certain embodiments the health can be sequentially determined for each of the electric lock-off valves of the split bottle gas system, as shown with box 262 and arrow 264. In this respect, subsequent to the determination of health of the first electric lock-off valve, each of the electric lock-off valves can again be commanded closed, a first measurement of gas pressure acquired, another of the electric lock off valves 130-134 opened, and a second measurement of pressure received for determining health of the another of the electric lock-off valves. It is contemplated that the method 200 continue iteratively until determination of health of each of the electric lock-off valves of the split bottle gas supply is made.

It is also contemplated that, in accordance with certain embodiments, method 200 can be automatically initiated. In this respect, as shown with box 202, a gas fill event can be detected by detection of displacement of a gas filling box during the filling operation. In this respect a door switch, e.g., the door switch 154 (shown in FIG. 2), can provide indication of closure of the door on the gas filling box 112 (shown in FIG. 1). The electric lock valves can then be closed subsequent to the closure of the door on the gas filling box, as shown with box 212. As will be appreciated by those of skill in the art in view of the present disclosure, this allows the first gas pressure measurement to be substantially equivalent of the fill pressure applied to gas bottles of the split bottle gas supply. Further, a gas engine connected to the split bottle gas supply can be started, e.g., TRU gas engine 106 (shown in FIG. 1), prior to closure of the first electric lock-off valve and acquisition of the second gas pressure measurement such that ability of the electric lock-off valve to close is tested, as shown with boxes 280 and 290.

The methods and systems of the present disclosure, as described above and shown in the drawings, provide transportation refrigeration systems, methods of determining health of electric lock-off valves in split bottle gas supplies for transportation refrigeration systems, and related computer program products with improved properties including the ability to isolate abnormal operation to a specific electric lock-off valve using a single pressure sensor. While the apparatus and methods of the subject disclosure have been shown and described with reference to preferred embodiments, those skilled in the art will readily appreciate that changes and/or modifications may be made thereto without departing from the spirit and scope of the subject disclosure.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A transportation refrigeration system, comprising:

a transportation refrigeration unit (TRU);

a gas circuit connected to the TRU and arranged to connect thereto a split bottle gas supply having a plurality of electric lock-off valves; and a controller operably connected to the TRU and responsive to instructions recorded on a memory to:

close the electric lock-off valves of the split bottle gas supply;

receive a first measurement of gas pressure in the gas circuit;

open a first of the electric lock-off valves of the split bottle gas supply;

receive a second measurement of gas pressure in the gas circuit; and determine health of the first electric lock-off valve using the first and second measurements of gas pressure in the gas circuit.

2. The system as recited in claim 1, wherein the instructions cause the controller to start the gas engine after opening the first electric lock-off valve.

3. The system as recited in claim 1, wherein the instructions cause the controller to close the first electric lock-off valve before receiving the second measurement of gas pressure in the gas circuit.

4. The system as recited in claim 1, wherein the instructions cause the controller to:

calculate a difference between the first measurement and the second measurement of gas pressure in the gas circuit;

determine that the first electric lock-off valve is operating normally when the difference is greater than a predetermined value; and determine that the first electric lock-off valve is not operating normally when difference is within the predetermined value.

5. The system as recited in claim 1, wherein the instructions cause the controller to sequentially determine health of each of the electric lock-off valves in the split bottle gas supply after determining health of the first electric lock-off valve.

6. The system as recited in claim 1, further comprising a user interface operatively associated with the controller, wherein the instructions cause the controller to display the determined health of the first lock-off valve on the user interface.

7. The system as recited in claim 1, wherein the instructions cause the controller to close the electric lock-off valves subsequent to receiving indication that the split gas bottle gas supply has been charged in a filling operation.

8. The system as recited in claim 1, further comprising a door switch disposed in communication with the controller and arranged for detecting displacement of gas filling box door during a filling operation.

9. The system as recited in claim 1, further comprising a pressure sensor arranged to measure gas pressure in the gas circuit and in communication with the controller.

10. The system as recited in claim 1, wherein the gas circuit is first gas circuit, and further comprising a second gas circuit gas circuit connected to the first gas circuit.

11. The system as recited in claim 1, further comprising:

a TRU gas engine operatively associated with the TRU;

the split bottle gas supply connected to the TRU gas engine by the first gas circuit;

a gas filling box connected to the split bottle gas supply by the first gas circuit;

a second gas circuit connected to the gas filling box;

a main gas bottle connected to the gas filling box by the second gas circuit; and a prime mover gas engine connected to the main gas bottle by the second gas circuit.

12. The system as recited in claim 1, further comprising the split bottle gas supply connected to the gas circuit, the split bottle gas supply comprising:

a pressure sensor connected to the gas circuit;

a manifold connected to the pressure sensor;

a first gas bottle with a first electric lock-off valve connected to the manifold, a first relay operatively associated with the first electric lock-off valve; and at least one second gas bottle with a second electric lock-off valve connected to the manifold, a relay operatively associated with each of the at one second electric lock-off valve, wherein the controller is disposed in communication with the pressure sensor to receive pressure measurements therefrom, and wherein the controller is operatively connected to the first electric lock-off valve and the second electric lock-off valve by the relay associated thereto to isolate the gas bottle connected to the lock-off valve from the pressure sensor.

13. A method of determining health of electric lock-off valves in a split bottle gas supply, the method comprising:

at a transportation refrigeration system includes a transportation refrigeration unit (TRU), a gas circuit connected to the TRU and arranged to connect thereto a split bottle gas supply having a plurality of electric lock-off valves, and a controller operably connected to the TRU, closing the electric lock-off valves of the split bottle gas supply;

receiving a first measurement of gas pressure in the gas circuit;

opening a first of the electric lock-off valves of the split bottle gas supply;

receiving a second measurement of gas pressure in the gas circuit; and determining health of the first electric lock-off valve using the first and second measurements of gas pressure in the gas circuit.

14. The method as recited in claim 13, the method further comprising:

starting the gas engine after opening the first electric lock-off valve; and closing the first electric lock-off valve before receiving the second measurement of gas pressure in the gas circuit.

15. The method as recited in claim 13, the method further comprising displaying health of the first electric lock-off valve on a user interface.

16. The method as recited in claim 13, the method further comprising:

calculating a difference between the first measurement and the second measurement of gas pressure in the gas circuit;

determining that the first electric lock-off valve is operating normally when the difference is greater than a predetermined value; and determining that the first electric lock-off valve is not operating normally when difference is within the predetermined value.

17. The method as recited in claim 13, the method further comprising sequentially determining health of each of the electric lock-off valves in the split bottle gas supply after determining health of the first electric lock-off valve.

18. The method as recited in claim 13, the method further comprising:

detecting displacement of gas filling box door during a filling operation; and closing the electric lock-off valves after receiving indication that the split gas bottle gas supply has been charged in the filling operation.

19. A computer program product tangibly embodied on a computer readable medium, the computer program product including instructions that, when executed by a processor, cause the processor to perform operations comprising:

closing electric lock-off valves of a split bottle gas supply;

receiving a first measurement of gas pressure in a gas circuit connected to the split bottle gas supply;

opening a first of the plurality electric lock-off valves of the split bottle gas supply; receiving a second measurement of gas pressure in the gas circuit; and determining health of the first electric lock-off valve using the first and second measurements of gas pressure in the gas circuit.

20. The computer program product as recited in claim 19, the operations further comprising sequentially determining health of each of the electric lock-off valves in the split bottle gas supply after determining health of the first electric lock-off valve.

* * * * *